US005774941A

United States Patent [19]

Huang et al.

[11] Patent Number: 5,774,941

[45] Date of Patent: Jul. 7, 1998

[54] TWO-HEAD ONE-CUBICAN DRAWING SYSTEM

[75] Inventors: C. T. Huang, Hsintien; C. T. Chang, Taipei; C. C. Huang, Tucheng; Sheng-Fu Chiu, Chungho; H. H. Chiou, Taipei, all of Taiwan

[73] Assignee: China Textile Institute

[21] Appl. No.: 889,963

[22] Filed: Jul. 10, 1997

[51] Int. Cl.[6] ..... D04H 11/00

[52] U.S. Cl. ..... 19/159 R; 19/65 A; 19/239; 19/240

[58] Field of Search ..... 19/159 R, 157, 19/145.5, 65 A, 239, 240

[56] References Cited

U.S. PATENT DOCUMENTS

| | | | |
|---|---|---|---|
| 2,630,243 | 3/1953 | Longstreet | 19/159 R |
| 4,236,278 | 12/1980 | Hoover | 19/159 |
| 5,428,869 | 7/1995 | Holubec et al. | 19/159 R |
| 5,428,870 | 7/1995 | Rutz et al. | 19/240 |
| 5,457,851 | 10/1995 | Mondini | 19/115 |
| 5,595,049 | 1/1997 | Leifeld | 53/430 |
| 5,621,948 | 4/1997 | Hartung | 19/159 A |
| 5,673,461 | 10/1997 | Sramek | 19/159 R |

*Primary Examiner*—William Stryjewski
*Attorney, Agent, or Firm*—Morton J. Rosenberg; David I. Klein; Jun Y. Lee

[57] ABSTRACT

The invention disclosed a two-head one-cubican drawing system provided with two sets of drafting mechanisms and two coilers. A cubic can is used to receive slivers from two coilers so as to decrease the space occupied by the system and facilitate the arrangement of automatic transportation. Through the control of driving mechanisms by transverse devices, evener drawing frames, and rollers the system can have two slivers equally formed in the cubic can.

6 Claims, 4 Drawing Sheets

TWO-HEAD ONE-CUBICAN DRAWING SYSTEM

BACKGROUND OF THE INVENTION

To improve the efficiency of preparatory spinning, spinning apparatus makers are focusing their efforts on making the process shorter and enhancing quality control of semi-finished products. The former emphasizes the optimal union of processing steps or the development of a single process to substitute for existing multistage processes. The latter consists in the development of a variety of monitoring systems to watch closely quality during the entire operation. Shortening the manufacturing process is beneficial to space saving. The present invention also provides such advantages, in addition to quality control by an evener. As to average sliver cans, the space efficiency of a round can is only around 0.9072. The space efficiency is calculated as follows: space efficiency$=(\pi r^2/2)/(\sqrt{3}*r^2)=\pi/(2*\sqrt{3})\approx 0.9072$ where r is the radius of a can. Further, a round can is adverse to transportation and storage.

In view of the above-mentioned problems, the primary object of the invention is to provide a two-head one-cubican drawing system that uses cubic cans to promote space efficiency (approaching 1) and can evenly feed two slivers in parallel into cubic cans by an innovative coiler to better quality.

BRIEF DESCRIPTION OF THE ACCOMPANYING DRAWINGS

FIG. 1 schematically illustrates the space efficiency of a round sliver can.

FIG. 2 schematically shows the coiling method according to the present invention.

DETAILED DESCRIPTION OF THE INVENTION

Figure 2:
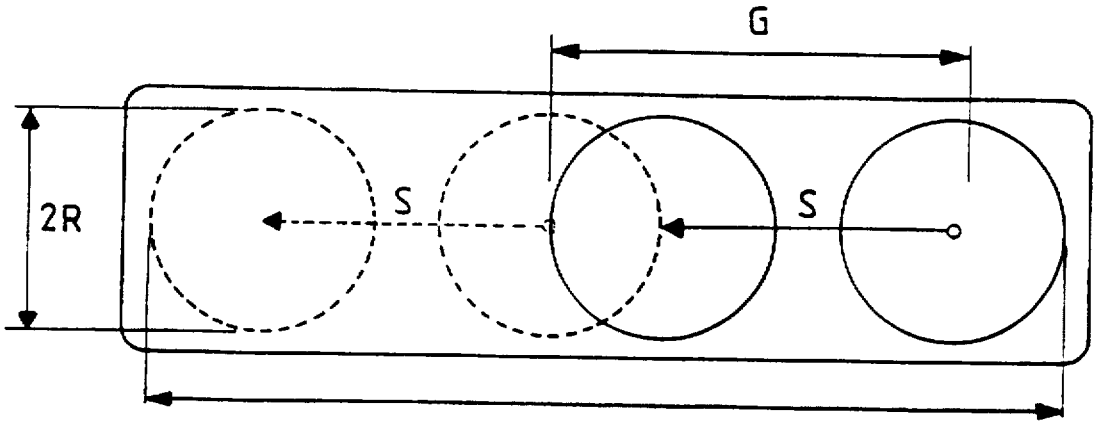
Figure 2:
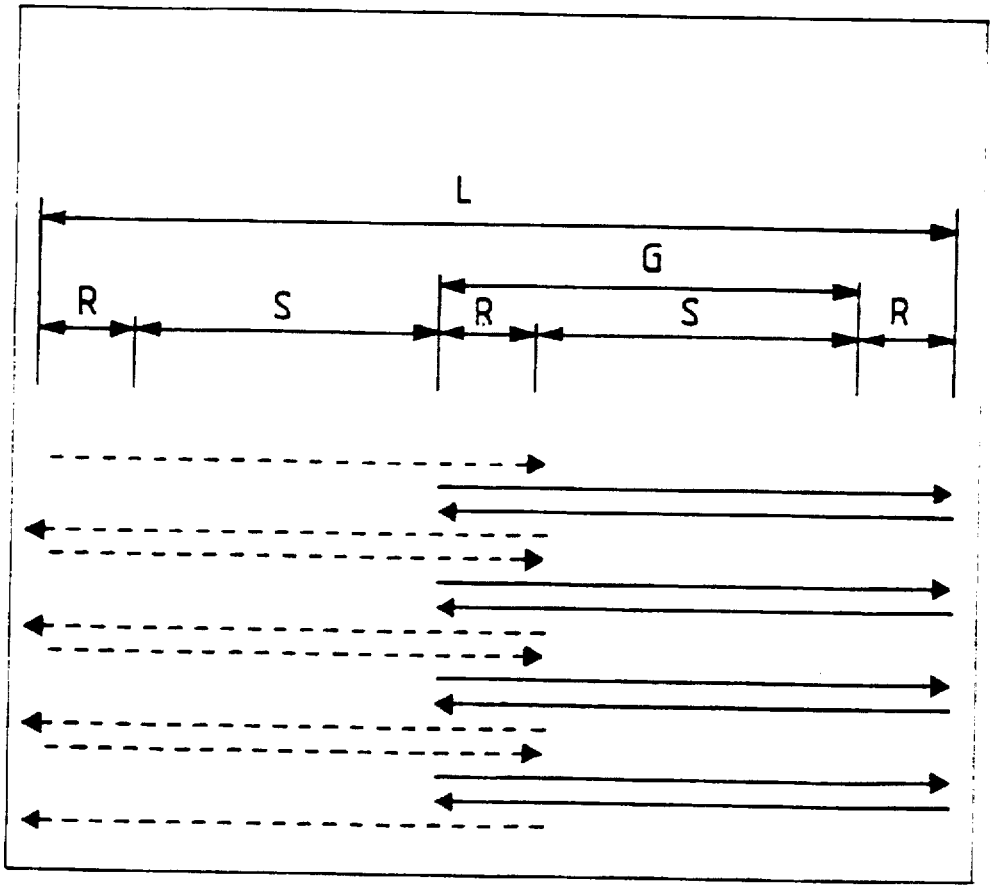

The coilers according to the invention are driven by a main motor so that two coilers run synchronously. The coilers wind sliver fibers into continuous rings and then a transverse device moves sliver cans reciprocatively so as to evenly distribute slivers into the cans. The stroke distance of the transverse device and the diameters of coiled slivers are designed to adapt to the size of sliver cans. In general, a transverse device with 32 to 33 centimeter stroke distances can produce sliver coils of a diameter ranging from 16 to 20 centimeters. Now refer to FIG. 2. The solid and hidden lines respectively represent sliver coils from different coilers. The center distance of the coilers equals to the sum of the stroke distance of the transverse device and the radius of sliver coils so that the most left position of sliver fibers on the right is at the center of the coiler on the left. Assuming that the maximum stroke distance of the transverse device is S, the radius of sliver coils is R, the center distance between two coilers is G, and the effective length of a sliver can is L, the center distance of coilers will be the sum of R and S and the effective length of a sliver can will equal to 3R+2S, as illustrated in the drawing. Once the size of cubic sliver cans is determined, the effective can length L and the radius R of sliver coils are fixed. The values of S and G are given as:

$$S=(L-3*R)/2$$

and $$G=(L-R)/2.$$

Figure 3:
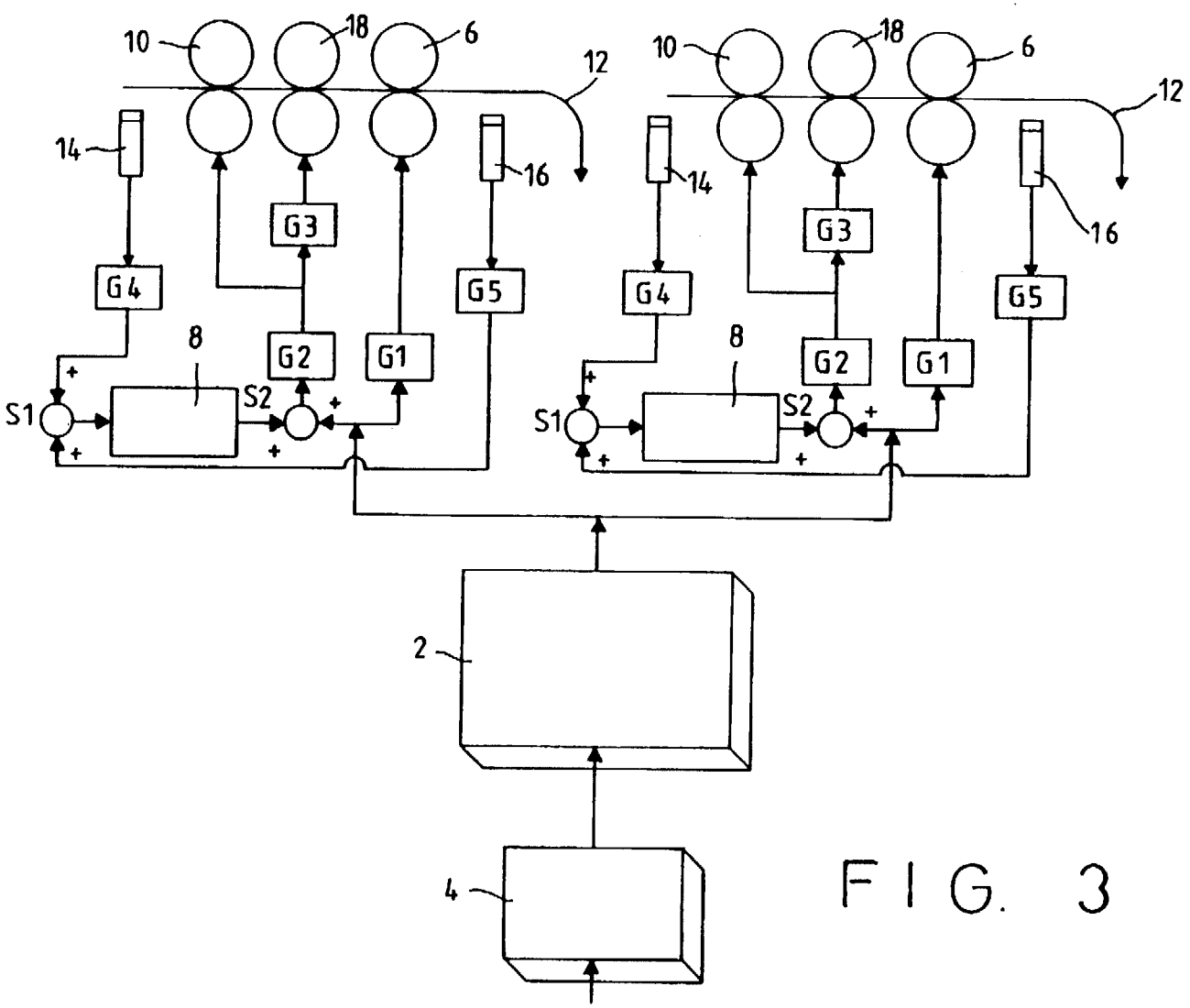
FIG. 3 shows the arrangement of a drawing system of the invention.

FIG. 3 shows a system and the drawing mechanism according to the invention that contains a main motor (2), which is a typical three-phase motor using a frequency converter to adjust its output speed. The output is transmitted via gears to the shafts of two sets of drafting rollers. G1 represents a ratio of the output speed of the main motor (2) to the rotating speed of the front roller (6). G2 is a ratio of the speeds of the main motor to that of the rear roller when the evener system is turned off and the servo motor (8) stands still. Further, G3 is the magnitude of an initial drafting. When the output speed is constant, the output speed of the main motor is fixed and thus each drafting roller rotates at a constant speed. At this point, the system has the same functions as an average draw frame.

As can be seen from FIG. 3, the input and output sides of the system are respectively provided with a sensor (14) and (16) for detecting the density of sliver fibers (12). G4 and G5 are processors for the signals from these sensors. The outputs of G4 and G5 are summated in a circuit S1 for the output control of a servo motor (8). S1 is a simple analog adder. The output power of the servo motor (8) is delivered into a middle and a rear roller (18) (10) through another circuit S2 so that the rollers (18) (10) run slower or faster. The purpose is reached by means of a gear set. With the gear set, the revolution of rollers (18) and (10) are linked to a linear combination of the rotating speeds of the main motor (2) and the servo motor (8). Even if the servo motor (8) does not have an output, it will not affect the operation of the system. Therefore, no matter what the output of the servo motor (8) is, the rotating speed of the front roller (6) and the feeding speed of sliver fibers can be kept constant, either the evener running or not.

The use of a sliver sensor (16) on the output side of the system can guarantee a precisely correct density of slivers (12). When the average sliver density is out of a preset range, the sensor will feed back a signal to the servo motor (8) so as to rectify the deviation. Such a closed-loop control can ameliorate the possible unevenness of sliver fibers in a long period. The sensor (14) on the input side of the system is used to monitor an instantaneous sliver weight. If the weight varies over a predetermined range, a signal is given to the servo motor (8) to response correspondingly. Thus here is an open loop control. It can mend the unevenness of sliver fibers in a short period.

From the above description, evidently the system according to the invention has the following advantages.

Figure 1:
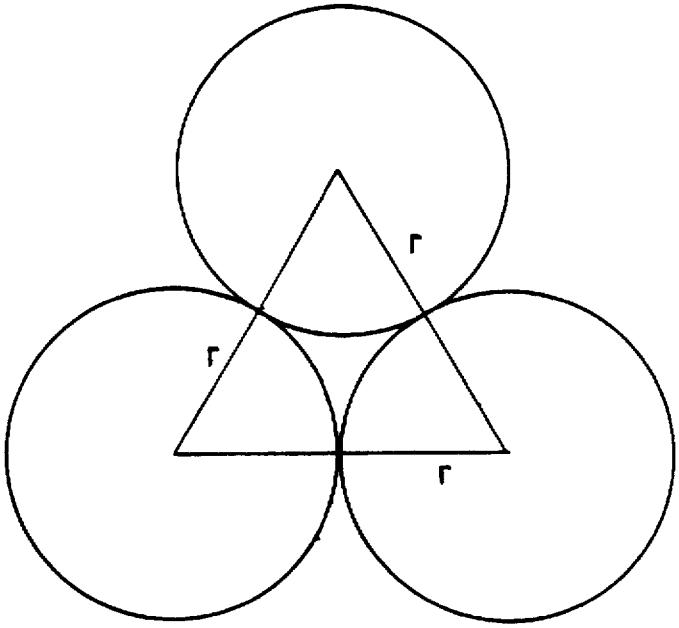

1. In comparison with a round can the use of cubic cans is more effective in space utilization and benefits transportation and storage. FIG. 1 shows a triangular area representing a typical arrangement pattern of round cans. The space efficiency is around ninety percent. However, it approaches 1 for a cubic can because cubic cans can be disposed in a more compact manner. Furthermore, adopting cubic cans is also helpful for automation because it is much easier to hold a cubic can than a round one.
2. The drafting mechanism and the evener do not affect the speed of front rollers. Two eveners are independent to each other in operation. Users have the option of running eveners and control the evenness of slivers in both a long duration and a short period. Hence it can effectively enhance product quality.

Figure 4:
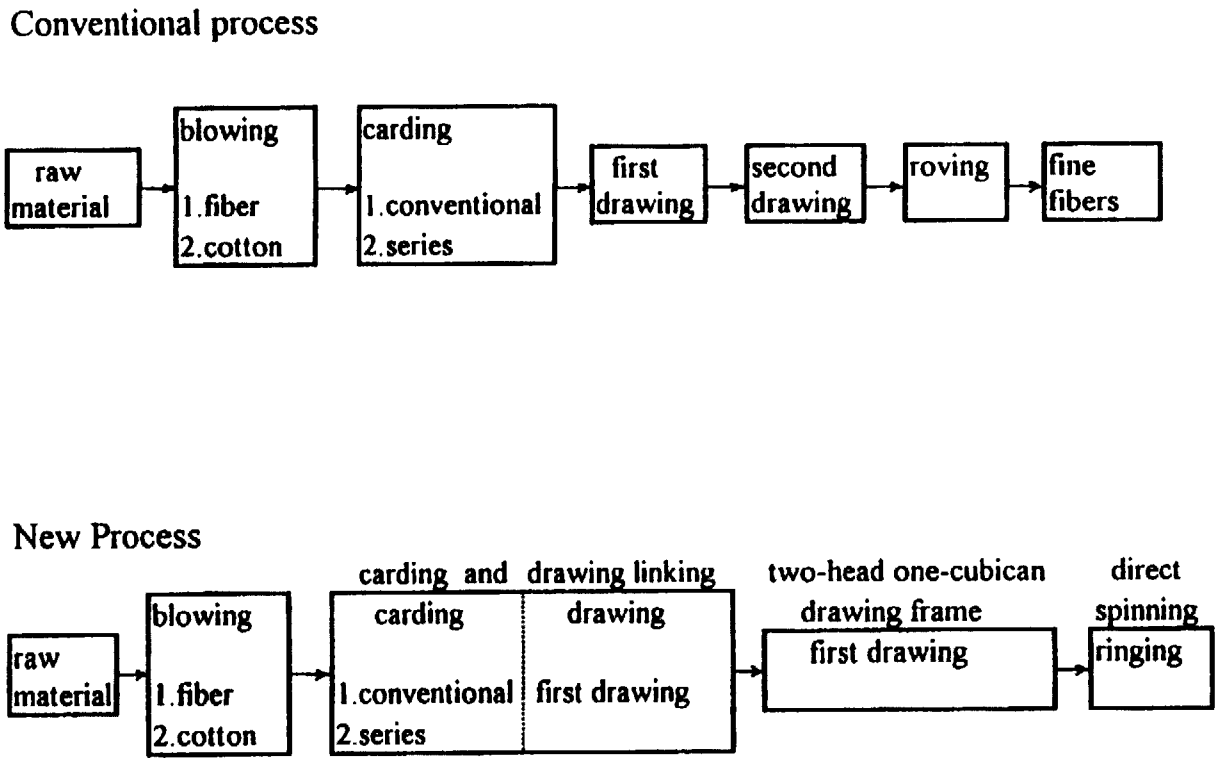
FIG. 4 illustrates a comparison between a conventional direct spinning procedure and the spinning procedure according to the invention.

3. The maximum stroke distance of a transverse device and the center distance of two coilers are adjustable for cubic cans of various sizes and the evenness of sliver fibers of two strands.
4. If the subsequent process is roving, the space requirement is only half the normal size because each sliver can supplies two strands of fibers. Additionally, blending two strands of slivers into a single strand can enhance quality and promote the evenness of mixed cotton fibers.
5. If the subsequent process is direct spinning instead of roving, the system of the invention can eliminate the drawback of a large space requirement.
6. The system of the invention, when operated in conjunction with a carding and drawing link system and a cotton direct spinning system, can save a plurality of processes and improve product quality. As shown in FIG. 4, it can adopt the new process for T/C or A/C blending before proceeding to mix in a carding machine.

What is claimed is:

1. A two-head one-cubican drawing system including a cubic sliver can and employing a main motor to drive two sets of drafting mechanisms and two coilers so as to have the cubic can receive two strands of sliver fibers; wherein a driving means comprise the main motor of which an output speed is changed by a frequency converter and that drives the shafts of front, middle, and rear rollers of two sets of the drafting mechanisms via a gear set to deliver cotton fibers into the cubic can; said main motor rotating at a constant speed and so does each drafting roller.

2. A two-head one-cubican drawing system as claimed in claim 1 wherein the cubic can simultaneously receives two strands of sliver fibers from two coilers.

3. A two-head one-cubican drawing system as claimed in claim 1 wherein a transverse device linked with said main motor is provided, the maximum stroke distance of said transverse device and the center distance of two coilers being adjustable for cubic cans of various sizes.

4. A two-head one-cubican drawing system as claimed in claim 1 wherein input and output sides of said drafting mechanisms are respectively provided with a sensor connected to an analog adder and a servo motor; said servo motor driving a gear set through a control circuit to change the speeds of middle and rear rollers for the evenness of sliver fibers while the front roller runs at a constant speed to deliver slivers at a constant rate.

5. A two-head one-cubican drawing system as claimed in claim 4 wherein when the linear density of output slivers varies out of a predetermined range, said sensor disposed on the output side of the drafting mechanism feeds a signal back to said servo motor for an adjustment to ameliorate the unevenness of sliver fibers in a long period.

6. A two-head one-cubican drawing system as claimed in claim 4 wherein the sensor disposed on the input side of the drafting mechanism monitors the instantaneous variation in the weight of incoming sliver fibers and feeds back to said servo motor for a corresponding response to rectify the unevenness in a short duration.

* * * * *